United States Patent [19]

Schulte

[11] Patent Number: 4,836,009

[45] Date of Patent: Jun. 6, 1989

[54] UPPER TOOL SUPPORT FOR A STAMPING MACHINE OR THE LIKE

[75] Inventor: Karl-Heinz Schulte, Lennestadt, Fed. Rep. of Germany

[73] Assignee: Muhr und Bender, Atterdorn, Fed. Rep. of Germany

[21] Appl. No.: 111,723

[22] Filed: Oct. 22, 1987

[30] Foreign Application Priority Data

Nov. 4, 1986 [DE] Fed. Rep. of Germany ..... 3637486

[51] Int. Cl.[4] ..... B21D 37/04; B21D 28/14; B21D 28/34

[52] U.S. Cl. ..... 72/446; 72/481

[58] Field of Search ..... 72/441, 442, 444, 446, 72/481, 482

[56] References Cited

U.S. PATENT DOCUMENTS 4,182,022 1/1980 Kristiansson ..... 72/446 X

FOREIGN PATENT DOCUMENTS 0180146 10/1985 European Pat. Off. .

2121037 8/1972 France ..... 72/441

*Primary Examiner*—E. Michael Combs

*Attorney, Agent, or Firm*—Browdy and Neimark

[57] ABSTRACT

An upper tool support (4) for a stamping machine or the like has at least two stamping tools (5) adjacently located. Each stamping tool (5) preferably includes a punch (7), a punch support (8) and a retaining nut (9) connecting the punch (7) with the punch support (8). The upper tool support (4) is provided with a support body (10), a receiving plate (11) with tool guides (12) for each stamping tool (5) disposed next to each other in the receiving plate (11), a locking cap (14). The locking cap (14) is connected to the support body (10) to be pivotable around a pivot axle (13), to be thus removable in a plane perpendicular to the direction of stamping. The upper ends of the stamping tools (5) are movably guided in the direction of stamping and limited in one direction by support flanges (15). The guidance of the stamping tools (5) is not influenced by the fastening of the locking cap (14) on the support body (10), because the locking cap (14) carries the receiving plate (11). The tool guides (12) are annularly closed in the plane perpendicular to the direction of stamping. The stamping tools (5) can be inserted into the tool guides (10) in the direction of stamping, that is, can be removed from the tool guides in the opposite, upward direction perpendicular to the receiving plate (11) when the locking cap (14) is pivoted away from the support body (10).

8 Claims, 4 Drawing Sheets

UPPER TOOL SUPPORT FOR A STAMPING MACHINE OR THE LIKE

BACKGROUND OF THE INVENTION

1. Field of the Invention

The invention relates to an upper tool support for a stamping machine or the like having at least two stamping tools adjacently located. Each stamping tool preferably includes a punch, a punch support and a retaining nut connecting the punch with the punch support. The upper tool support is provided with a support body, a receiving plate with tool guides for each stamping tool disposed next to each other in the receiving plate, and a locking cap. The locking cap is connected to the support body to be pivotable around a pivot axle, and is thus pivotably removable from the support body in a plane perpendicular to the direction of stamping. Upper ends of the stamping tools are movably guided in the direction of stamping, and limited for motion in this one direction, by support flanges from the support body.

The following explanations basically relate not only to the upper tool supports of machine tools in the form of stamping machines, but also, for example, to cases where two or more ratchet-driven tools are disposed next to each other. The teaching of the invention thus is not limited to a stamping machine and to stamping tools, but applies to all machine tools in which comparable problems exist. In order to facilitate the understanding of the teaching, the teaching of the invention is described here and below by means of the preferred exemplary embodiment of an upper tool support for a stamping machine.

2. The Prior Art

In the known upper tool support for a stamping machine or the like which is the background art out of which the present invention arises (EP-A-O 180 146), a quick change of a stamping tool and/or of all stamping tools is possible, taking into consideration the limited space where several stamping tools are located next to each other. If the receiving plate is a part of the support body, and if the tool guides are open in for instance the horizontal direction towards the front of the support body, then the upper ends of the stamping tools can be generally pushed into or placed horizontally in the tool guides. The locking cap locks all tool guides together at the open ends. By means of application of the locking cap which is then locked, the open ends of all tool guides in the receiving plate are locked in one step. Thus all stamping tools are secured. For this purpose the individual ends of the stamping tools are provided with hammerhead-like enlargements, and the receiving plate and the locking cap are provided with support flanges corresponding to the hammerhead-like enlargements, so that the stamping tools cannot slip downwardly out of the tool guides. The locking cap is pivotably fastened on the support body, or to the receiving plate, via a pivot axle and is lockable with the support body (or the receiving plate) by means of a locking device disposed on the opposite lateral side. The locking device has a locking bolt pivoting in the horizontal plane on the receiving plate and a bolt receptacle provided on the locking cap and open on one side. The locking bolt is pivotable into the bolt receptable, and fixable therein by means of an adjusting nut for locking. Furthermore, receptacles for the upper ends of the stamping tools are provided in the support body above the tool guides and below a power transfer area, and these receptacles can be bridged by means of power transfer rods generally movable perpendicularly to the stamping direciton. With each stamping tool is associated a lifting lever, one end of which laterally engages the upper end of the associated stamping tool from below, so that the upper end of the stamping tool can be lifted into the receptacle by means of the lifting lever when the power transfer rod is pulled back. Pneumatic drives or the like, not further described, are provided for this purpose.

The upper tool support previously described and forming the background for the teaching of the present invention cannot, for all practical purposes, be improved in regard to the quick exchangeability of the stamping tools. However, it has been shown in practice that the half shell design of the receiving plate and the locking cap for forming the tool guides has its problems. If the locking device is overly tightened, the stamping tools possibly become wedged in the tool guides. This prevents the upper tool support from functioning, and gives rise to the possibility of damaged stamping tools or even of other parts of the machine being damaged.

SUMMARY OF THE INVENTION

It is an object of the invention to design and improve the known upper tool support for a stamping machine or the like in such a way that the guidance of the stamping tools is not affected by the positioning of the locking cap on the support body. The upper tool support according to the invention in which the above mentioned object is attained is characterized in that the locking cap surrounds the receiving plate, in that the tool guides are annularly closed in the plane perpendicular to the stamping direction, and in that the stamping tools can be inserted into the tool guides, or pulled out of the tool guides, in the direction of stamping, or, respectively, in the direction perpendicular to the receiving plate when the locking cap is removed, such as being pivoted away from, the support body. The invention does not involve the disposing of the tool guides in the form of half shells partly in the locking cap and partly in the receiving plate. Rather, in accordance with the invention, the tool guides are provided completely and in one piece in the receiving plate, the receiving plate thus being part of the locking cap and therefore completely removable from the support body. With the locking cap removed, particularly pivoted away from the support body, the stamping tools can be, for all practical purposes, removed from or inserted into the tool guides in the direction of stamping, or in the upward direction perpendicular to the receiving plate, the same as was possible up to now with the insertion, or the removal, respectively, from the half shell receivers. At the same time, the stamping tools are not disturbed in the tool guides, since the tool guides are annularly closed on all sides. The cross section of the tool guides in the plane of the receiving plate therefore can no longer be changed by the amount of tightening of the locking device. Wedging of the stamping tools is impossible.

There are a number of possibilities which would occur to a skilled worker in the art for designing and improving the upper tool support for a stamping machine or the like, in accordance with the present invention, which is not limited to the exemplary embodiment described below and illustrated in the drawings.

DETAILED DESCRIPTION OF THE PREFERRED EMBODIMENT

Figure 1:
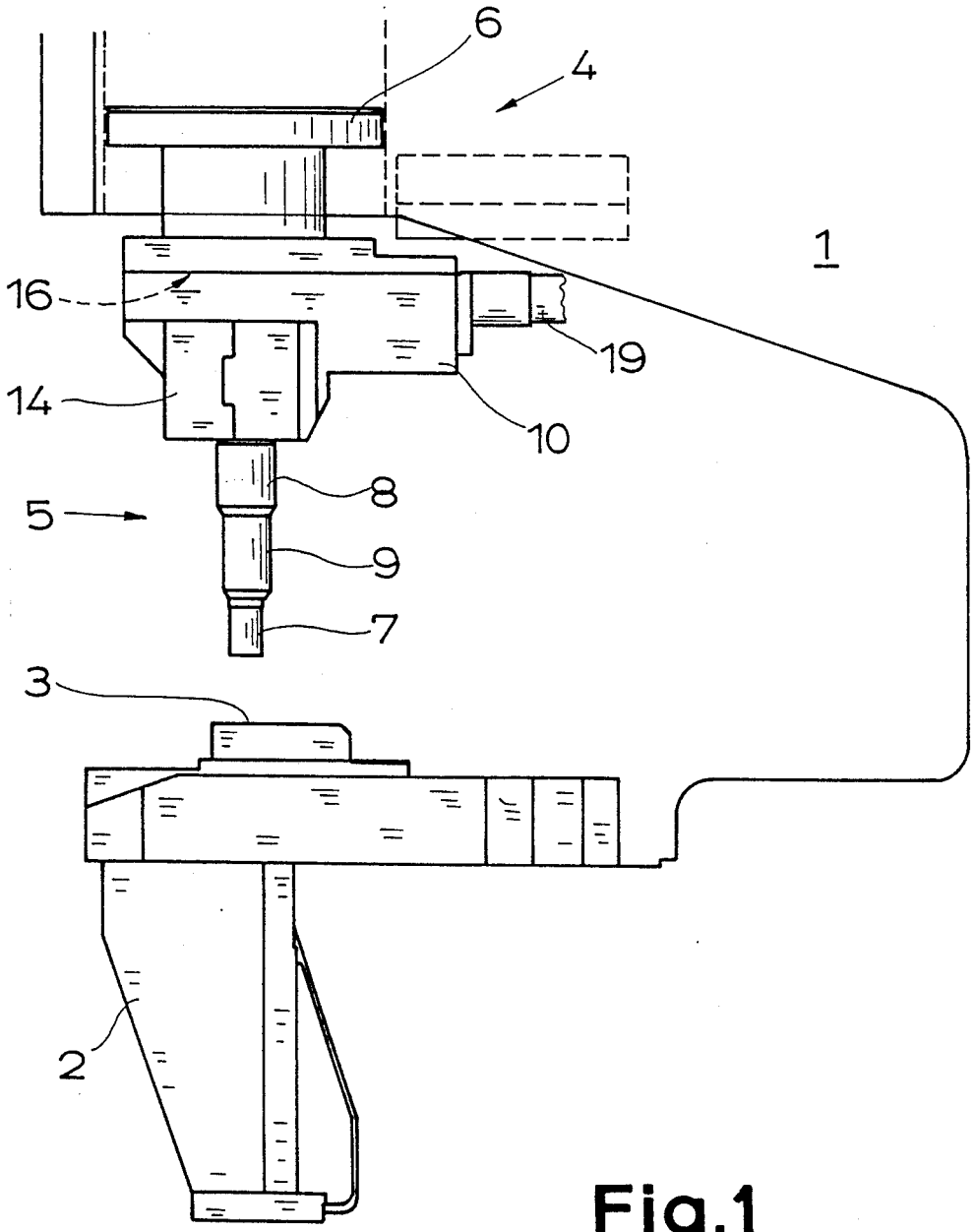
FIG. 1 is a schematic side view of a machine tool, in this case a punching press.

FIG. 1 indicates a preferred exemplary embodiment of the machine tool, according to the present invention in the form of a punching press having a machine body 1 in the form of the letter C. A lower tool support 2 is provided or otherwise fixed on the machine body 1 and a lower tool 3 is provided thereon and an upper tool support 4 with an upper tool, in this case a stamping tool 5, is provided or otherwise fixed on the upper part of the machine body 1. As also indicated in FIG. 1, a drive head 6, for example in the form of a hydraulic cylinder-piston device, is located on the upper tool support 4, or the machine body 1 above the upper tool support 4, by means of which the stamping tool 5 can be lowered for operation in the direction of the lower tool 3.

Figure 2:
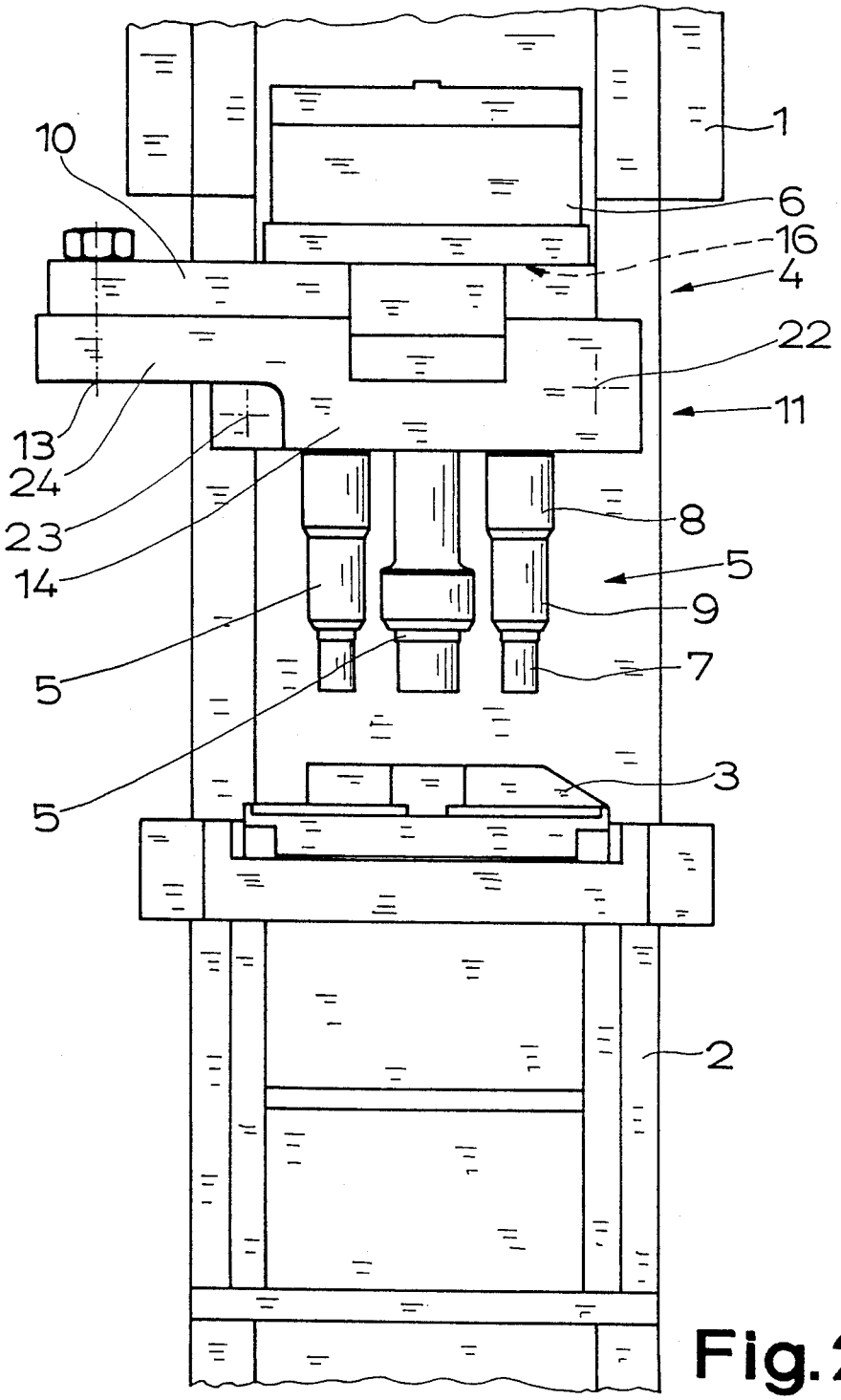
FIG. 2 is a front view of the punching press.

As FIGS. 1 and 2 show in combination, the upper tool support 4 is characterized in that for instance three stamping tools 5 are provided, located next to each other. In the exemplary embodiment shown here, each stamping tool 5 has a punch 7, a punch support 8 and a retaining nut 9 connecting the punch 7 with the punch support 8. As shown in FIG. 2, the three stamping tools 5 are placed as closely as possible next to each other.

These drawings show that the upper tool support 4 in this exemplary embodiment has a support body 10 as well as a receiving plate 11.

Figure 3:
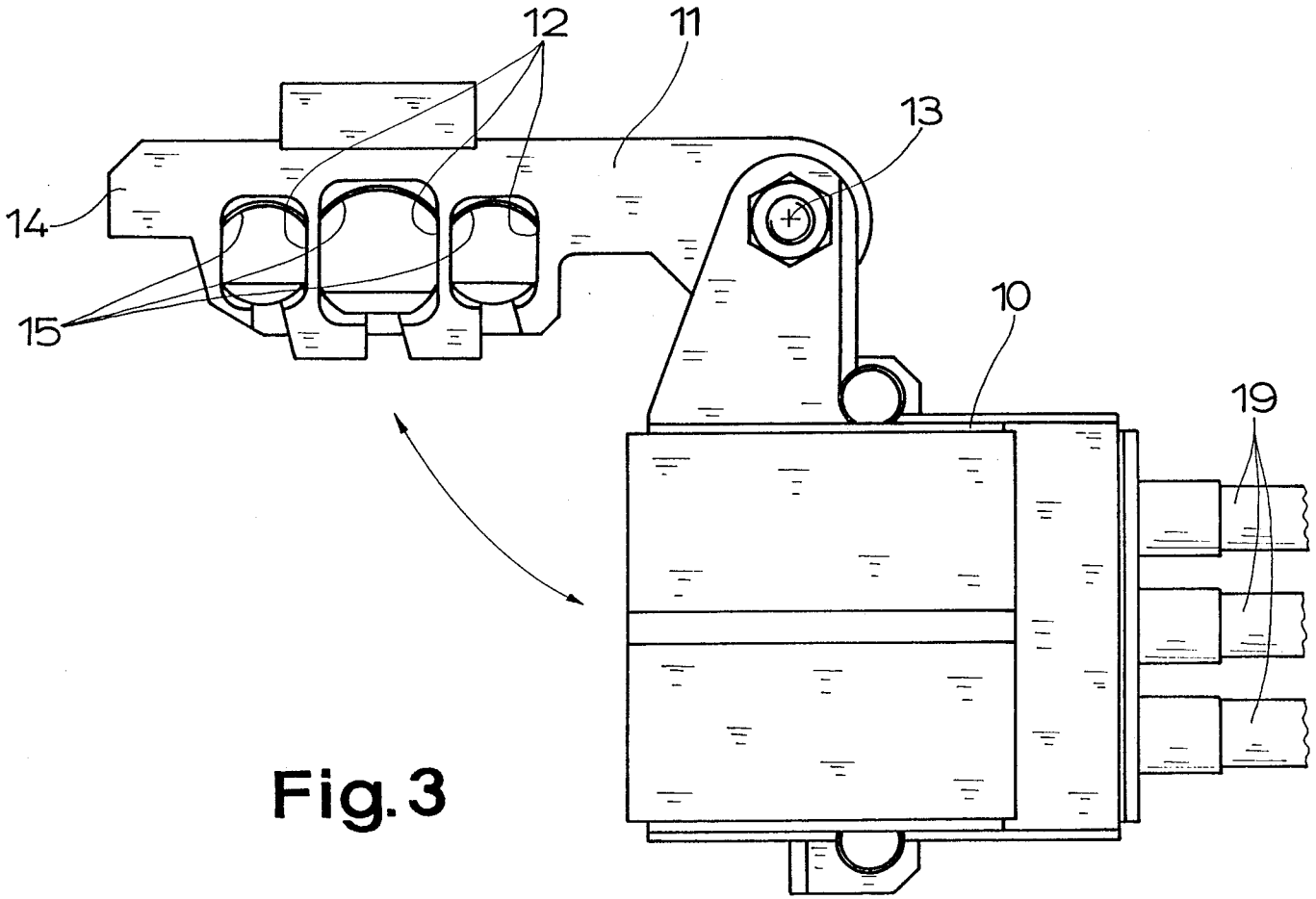
FIG. 3 is a top view of the punching press.

FIG. 3 illustrates that tool guides 12 are provided for each stamping tool 5, the tool guides 12 being located next to each other extending in the direction of stamping. FIGS. 1–3 taken together further illustrate that the upper tool support 4 has a locking cap 14 fastened on the support body 10 which, in the exemplary embodiment shown here, is pivotable around a pivot axle 13 on the support body 10. Finally, FIGS. 1 and 2 together show that the upper ends of the stamping tools 5 are guided movably in the direction of stamping, in this case vertically, in the tool guides 12. Support flanges 15 for the stamping tools 5 are shown in FIG. 3, namely they are intended to prevent the stamping tools 5 from falling downward out of the tool guides 12.

Although not shown in the drawings, the upper ends of the stamping tools 5 are provided with hammerhead-like enlargements which bear on the support flanges 15 provided in the tool guides 12, so that the downward slipping-through of the stamping tools 5 is prevented, as known in the art. Also, further details of the known upper tool support 4 can be seen from the prior art publication EP-A-O 180 146 which is incorporated here for background description.

Figure 4:
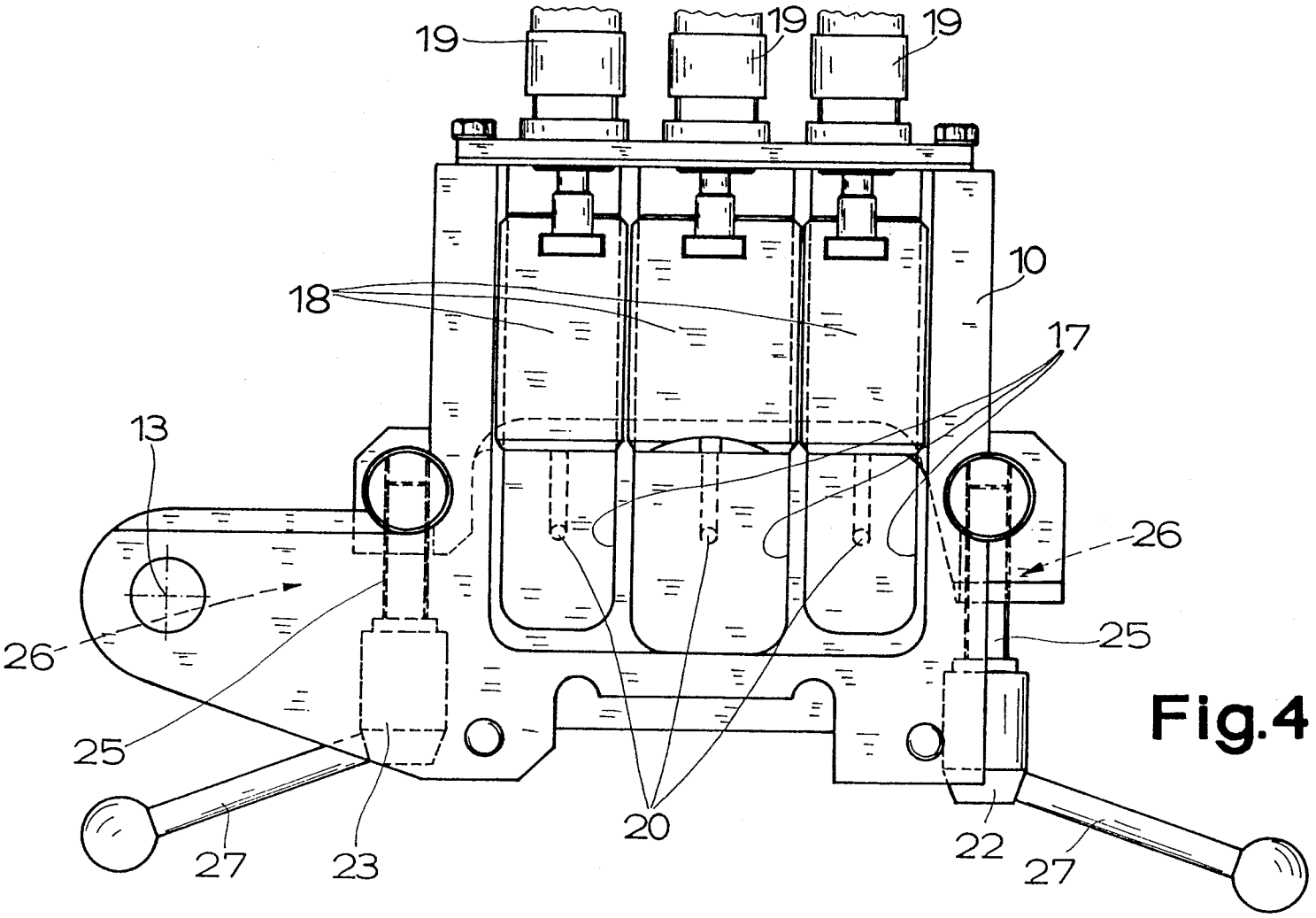
FIG. 4 is a top view of the punching press with the drive head removed.

As shown in FIG. 4 of the drawings, receptacles 17 for the upper ends of the stamping tools 5 are also provided in the upper tool support 4, which is described in this example to be on the support body 10 above the tool guides 12 and below a power transfer area 16. The receptacles 17 can be bridged by means of power transfer rods 18 or the like, generally movable perpendicularly to the stamping direction, with the aid of actuating drives 19 which are illustrated here in the form of pneumatic cylinder-piston units. The power transfer area 16 is disposed on the underside of the drive head 6. This arrangement makes it possible that during the downstroke of the power transfer area 16, for instance, only one stamping tool 5 is selected to be actively moved downwardly, namely the one having its power transfer rod 18 bridging the associated receptacle 17, while the other two stamping tools 5 remain in their respective associated receptacles 17.

In order not to permit the non-activated stamping tools 5 to be moved back by the upper side of a work piece into the receptacles 17, but rather to return them actively into the receptacles 17, it is also known to associate with each stamping tool 5 a lifting lever 20 disposed on the support body 10. FIG. 4 indicates a lifting lever 20 for each receptacle 17. The lifting lever 20 can laterally engage the upper end of the associated stamping tool 5 from below, so that the upper end of the stamping tool 5 can be lifted into the receptacle 17 by means of the lifting lever 20 when the power transfer rod 18 is drawn out of the receptacle 17.

Details of the exemplary embodiment of the present invention can be seen in FIG. 3 to involve the locking cap 14 which carrier the receiving plate 11 extending in a plane perpendicular to the stamping direction, so that the tool guides 12 are annularly closed in all directions in the plane perpendicular to the stamping direction. Further, the stamping tools 5 can be inserted into the tool guides 12, or pulled out of the tool guides 12, in the direction of stamping or in the upward direction vertical to the receiving plate 11, respectively, when the locking cap 14 is removed for instance by being pivoted away from the support body 10. The advantages of this design with annularly closed tool guides 12 in the locking cap 14 have been described in detail above so that further explanations here are not necessary.

FIG. 3 further shows that, in conformance with the lifting levers 20 for the lifting of the ends of the stamping tools 5 as described above, the locking cap 14 has, on its side oriented towards the support body 10 and at each tool guide 12, an channel 21 for the respective lifting lever 20, which leads into the tool guide 12 underneath the support flange 15. Thus the lifting levers 20 can engage the stamping tools 5 via the channels 21, namely at the hammerhead-like enlargement at the upper end of the stamping tool 5, when the locking cap 14 is fastened on the support body 10. This insertion of the lifting levers 20 automatically takes place during the pivoting of the locking cap 14 when the locking cap 14 is pivoted towards the support body 10. In this connection it is recommended to enlarge the channels 21 in the locking cap 14 on the sides oriented towards the pivot axle 13 for the pivoting on the support body 10, from the tool guides 12 in the direction of the side oriented towards the support body 10. This corresponds with the arcuate movement of the channels 21 around the pivot axle 13.

FIGS. 2 and 3 as well as FIG. 4 of the drawings show that in this preferred exemplary embodiment the center of the pivot axle 13 for the pivoting of the locking cap 14 on the support body 10 is laterally disposed at a considerable distance, preferably at a distance of approximately 100 mm to 200 mm, particularly of approximately 150 mm, from the nearest edge of the nearest tool guide 12. This laterally cantilevered design of the support body 10 and the locking cap 14 has the advantage that the upper ends of the stamping tools 5 can easily be pulled out of the tool guides 12 in the receiving plate 11 in an upward direction. The lateral minimum distance of the pivot axle 13 from the nearest tool guide 12 assures that, even in the presence of projecting parts of the upper tool support 4, the tool guides 12 can be distanced sufficiently from the support body 10 to be completely free the insertion path for the stamping tools 5.

In the state of the art which is the background of the teaching of the instant invention, the locking cap 14 can be locked to the support body 10 by means a locking or fastening device 22, particularly a locking device 22 disposed on the side opposite from the pivot axle 13. FIGS. 2 and 4 together show that in accordance with the illustrated embodiment of the invention a second locking a fastening device 23 is disposed in the vicinity of the pivot axle 13 and below an end part 24 of the locking cap 14 in which the pivot axle 13 is provided. The locking device 23 can be designed in the manner used for the locking device 22 previously described, namely with a locking bolt 25 pivoting in the horizontal plane on the support body 10 and a bolt receptacle 26 provided on the locking cap 14, preferably open on the lateral side. The locking bolt 25 as illustrated is pivotable into the bolt receptacle 26 and fixable by means of an adjusting nut 27 or the like for locking. The adjusting nut 27 or the like can be in the form of a knee tension lever as also indicated in FIG. 4. The disposition of the second locking device 23 below the part 24 of the locking cap 14 makes it possible, after pivoting the locking bolt 25 with the adjusting nut 27 to the left in FIG. 2, to aslo swing the locking cap 14 to the left without colliding with the locking device 23.

What is claimed is:

1. An upper tool support for a stamping machine or the like, supporting at least two adjacently located stamping tools for stamping in a stamping direction, comprising a support body having a power transfer area, and a locking cap supported by and fastened to said support body, said locking cap being removable from said support body in a plane perpendicular to said stamping direction, wherein said locking cap carries a receiving plate extending in said perpendicular plane including tool guides disposed next to each other therein for movably guiding upper ends of said stamping tools in said stamping direction, said tool guides extending in said stamping direction and being annularly closed in said perpendicular plane with respect to said stamping direction, and wherein said stamping tools are insertable into and removable from said tool guides in said receiving plate of said locking cap by moving each said stamping tool in said stamping direction, which is in a direction perpendicular to said receiving plate, when said locking cap is removed from said support body.

2. The support of claim 1, wherein said locking cap is pivotably attached to said support body by means of a pivot axle disposed at one end of said locking cap and wherein said stamping tools are insertable into and removable from said tool guides when said locking cap is pivoted away from said support body.

3. The support of claim, wherein on said receiving plate, adjacent to each of said tool guides, support flanges are formed for limiting said movement of said stamping tools in said stamping direction.

4. The support of claim 1, comprising receptacles for said upper ends of said stamping tools in said support body, said receptacles in said support body being located above said tool guides and below said power transfer area, power transfer rods bridging said receptacles and being movable generally perpendicular to said stamping direction into or out of said receptacles below said power transfer area, a respective lifting lever mounted on said support body for each said stamping tool, each said lifting lever laterally engaging said upper end of the associated stamping tool from below, wherein by means of the respective lifting lever the upper end of each said stamping tool can be lifted into the respective receptacle when the respective power transfer rod is drawn out of said receptacle, and wherein said locking cap has on a side oriented towards said support body and at each said tool guide a respective channel for the respective lifting lever, and each said channel leads into the respective tool guide.

5. The support of claim 4, wherein on said receiving plate, adjacent to each of said tool guides, support flanges are formed for limiting said movement of said stamping tools in said stamping direction and said channel leads into the respective tool guide underneath said support flange.

6. The support of claim 4, wherein said locking cap is pivotably attached to said support body by means of a pivot axle disposed at one end of said locking cap and wherein each said channel in said locking cap on said side oriented towards said support body is sloped outwardly said pivot axle so as to enlarge said channel.

7. The support of claim 2, wherein said pivot axle for the pivoting of said locking cap on said support body is laterally disposed on said locking cap at a distance of between 100 mm and 200 mm from the nearest edge of the nearest tool guide.

8. The support of claim 2, comprising a fastening means for fastening said locking cap on said support body, said fastening means including a first fastening device disposed on a first end of said locking cap at a side away from said pivot axle, and a second fastening means disposed on a second end of said locking cap in the vicinity of said pivot axle and below where said locking cap pivots from said pivot axle.

* * * * *